US006457213B2

(12) United States Patent
Watanabe

(10) Patent No.: US 6,457,213 B2
(45) Date of Patent: Oct. 1, 2002

(54) TACK FOR BUTTON

(75) Inventor: Hirokazu Watanabe, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/735,554

(22) Filed: Dec. 14, 2000

(30) Foreign Application Priority Data

Dec. 24, 1999 (JP) ..... 11-367031

(51) Int. Cl.[7] ..... A44B 1/42
(52) U.S. Cl. ..... 24/94; 24/95; 24/96; 24/113 R
(58) Field of Search ..... 24/94, 95, 96, 24/113 R, 113 MP

(56) References Cited

U.S. PATENT DOCUMENTS 2,018,105 A * 10/1935 White ..... 24/95
3,028,646 A * 4/1962 Janes ..... 24/94
4,571,780 A * 2/1986 Fukuroi ..... 24/95
4,607,415 A * 8/1986 Fukuroi ..... 24/94
4,788,753 A * 12/1988 Sparrow et al. ..... 24/113 MP
4,943,197 A * 7/1990 Baritz ..... 24/113 MP
5,575,043 A * 11/1996 Candotti ..... 24/113 R

* cited by examiner

*Primary Examiner*—Victor Sakran
(74) *Attorney, Agent, or Firm*—Finnegan, Henderson, Farabow, Garrett, & Dunner, LLP

(57) ABSTRACT

The present invention provides a tack which prevents puckering phenomenon from being generated when the tack is pierced into cloth and enables a firm engagement between the tack and a boss portion of a button. In the tack for button, a cylindrical post stands on the center of a seat plate and a quadrangular pyramid shaped head is formed at an end of the post. The head is pointed such that a vertical angle of each of peripheral faces of the head is in a range of 20 to 40°. Four corners on a proximal periphery of the head are protruded out of an outer peripheral face of the post so as to form an engaging portion which bites into a wall face of an attaching hole in a boss portion of the button. When the tack is pierced into cloth, because the head makes a linear contact with the cloth and it is pointed, no puckering phenomenon occurs, thereby making it possible to engage and fix the tack to the boss portion firmly.

7 Claims, 8 Drawing Sheets

TACK FOR BUTTON

BACKGROUND OF THE INVENTION

1. Field of the Invention

The present invention relates to a metallic tack for use upon attaching a button for jeans to its cloth and more particularly to a button attaching tack which never induces puckering phenomenon in the cloth when the cloth is pierced therewith.

2. Description of the Related Art

According to a conventional tack 1' for button disclosed in Japanese Utility Model Publication No. 63-10729, as shown in FIG. 13, a cylindrical post 4' stands on the center of a seat plate 3'. The post 4' is made of metal and an end of the post 4' is ground to have a head 5' shaped in quadrangular pyramid. Concave portions 21' are formed in the post 4' below the head 5' so as to facilitate deformation of the head 5'. After this tack 1' is pierced into cloth, it is inserted into a boss portion of a metallic button. At this time, the head 5' is pressed, so that it is deformed through the concave portions 21' in the post 4' thereby the head being fixed in the boss portion.

Further, according to a tack 1' for button disclosed in Japanese Utility Model Laid-Open Publication No. 60-69008, as shown in FIG. 14, a cylindrical post 4" stands on the center of a seat plate 3". An end of the post 4W is formed to have a conical head 5" protruded with respect from an outer periphery of the post 4". Then, plural stages of truncated cone-shaped engaging portions 8" protruded with respect to the outer periphery of the post 4" like the head 5R are formed in the post 4" below the head 5". After this tack 1" is pierced into cloth, it is inserted into an attaching hole formed in a boss portion of resin made button. Consequently, the tack for button is fixed in the boss portion by means of the head 5" and the engaging portions 8".

The aforementioned tack 1' for button shown in FIG. 13 is different from a tack of the present invention in engagement manner between the tack 1' and the boss portion of a button. In case of this conventional tack 1', it is fixed to the boss portion of a metallic button by deforming a front end of the tack 1' by pressure. Therefore, the tack 1' is so constructed that the post 4' and head 5' are connected to form a smooth surface and has no engaging portion which protrudes with respect from the post. Thus, there is such a problem that this tack cannot be fixed easily to the boss portion of a resin button.

Further, the tack 1" for button shown in FIG. 14 has a problem that because the head 5" formed at an end of the post 4" is conical, when the tack is pierced into cloth, the head 5" makes facial contact with the cloth so that a large resistance is generated thereby often leading to the puckering phenomenon.

SUMMARY OF THE INVENTION

The present invention has been accomplished in view of the above described problems and an object of a main aspect of the invention is to provide a tack for button for use upon fixing a jeans button to jeans cloth, wherein a head thereof is formed in a shape not making a facial contact with cloth producing a large contact resistance but making a linear contact with cloth producing a less resistance when the tack for button is pierced into the cloth, so that no puckering phenomenon occurs. This tack has a simple structure and tough engaging mechanism so that it can be engaged with the boss portion firmly and fixed thereto.

It is also an object of the present invention is to provide a tack for button, wherein a proximal periphery of the head is protruded outwardly of a post so that the head of the tack engages firmly with the boss portion of a button, or a tack for button capable of being pierced easily, which can be engaged with the boss portion of a button with corners of the head.

Another object of the present invention is to provide a tack for button, wherein the corners of the head are exposed more so that they can be engaged firmly when the proximal end of the head is engaged with the boss portion of the button, thereby the engaging performance is improved.

A further object of the present invention is to provide a tack for button, wherein the post thereof can be engaged firmly with the boss portion of the button by means of engaging protruding portion disposed above the post, thereby the engaging performance is improved.

Another object of the present invention is to provide a tack for button, wherein the shape of the head thereof is formed in a pointed shape allowing it to be pierced into cloth easily, thereby facilitating the piercing operation.

Another object of the present invention is to provide a tack for button and a boss portion, which are formed using specified materials in a shape matching with each material, thereby achieving easy and firm engagement between the tack for button and the boss portion.

To achieve the above object, according to the main aspect of the invention, there is provided a tack for button, wherein a post stands upward from the center of a flat seat plate; a polygonal pyramid shaped head is formed integrally at an end of the post; and sharp and strong corners provided on a proximal periphery at a lower end of the head are protruded out of a peripheral face of the post so as to form an engaging portion, thereby the engaging performance of the head being intensified.

Preferably, the proximal periphery at a lower end of the polygonal pyramid shaped head, which is provided at an end of the post, is protruded out of an outer peripheral face of the post, thereby the engaging performance of the head being intensified.

Alternatively, part of the proximal periphery of the corner in the polygonal pyramid head, which is provided at an end of the post, is located inside with respect to the outer peripheral face of the post, thereby the engaging performance and piercing function of the head being intensified.

Preferably, a bottom face of each of the corners of the head extends inwardly at a border between the head and the post so that a neck portion thinner than the post is formed, thereby the engaging performance of the head being intensified.

Also preferably, a neck portion thinner than the post is formed under the head formed on the tack; an engaging protruding portion is provided on the post below the neck portion so as to protrude therefrom, thereby the engaging performance of the tack being intensified.

Preferably, a vertical angle of each of peripheral faces formed on the polygonal pyramid head, which is provided at an end of the post, is in a range of 20 to 40° to make the head sharp, thereby the piercing performance of the head being intensified.

Preferably, the tack is formed of metal and the boss portion in which the tack is to be inserted is formed of thermoplastic resin, thereby the engaging performance between the tack and the boss portion of a button being intensified.

DESCRIPTION OF THE PREFERRED EMBODIMENTS

Hereinafter, the preferred embodiments of a tack for button of the present invention will be described in detail with reference to the accompanying drawings.

Figure 1:
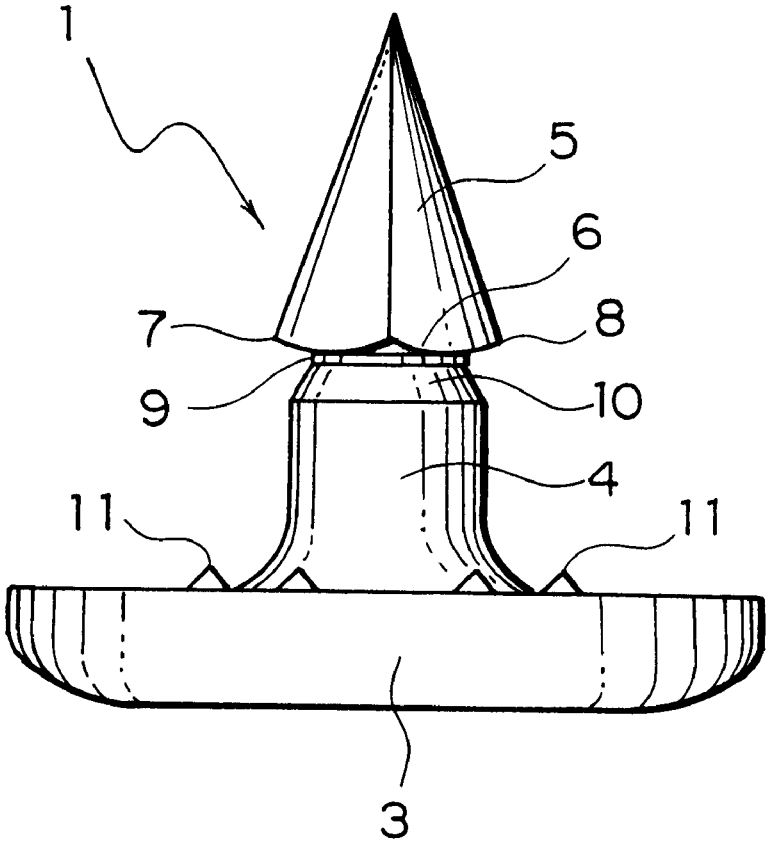
FIG. 1 is a front view of a tack according to a first embodiment of the present invention.
Figure 2:
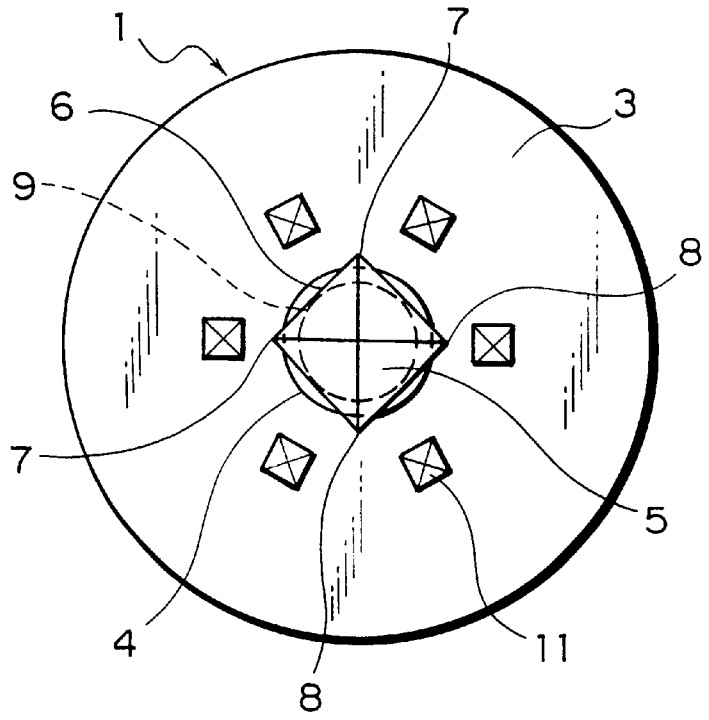
FIG. 2 is a plan view of the tack of FIG. 1.

According to a tack 1 for button according to a first embodiment of the present invention, as shown in FIGS. 1 and 2, a cylindrical post 4 stands upward from the center of a flat disc-shaped seat plate 3 and a quadrangular pyramid shaped head 5 is provided integrally at an upper end of this post 4. By forming this quadrangular pyramid head such that a vertical angle of a peripheral face of the head 5 is 20 to 40°, the head 5 is formed to be sharp. Then, four corners 7 formed on a proximal periphery 6 located below, namely on a seat plate 3 side of the head 5 protrude outside of an outer periphery of the post 4 below the head 5, thereby forming engaging portions 8.

A bottom face of the corner 7 of the head 5 extends inwardly substantially horizontally at a border between the post 4 and the head 5 so that a neck portion 9 is formed to be thinner than the post 4. Then, a surface of the post 4 just below this neck portion 9 is formed as an inclined slope portion 10. As shown in FIG. 2, the outer periphery of the neck portion 9 substantially coincides with the proximal periphery 6 disposed between the corner 7 and corner 7 of the quadrangular pyramid head 5 in a vertical relationship. The slope portion 10 of the post 4 is formed so as to partially protrude out of the proximal periphery between the corner 7 and corner 7 of the head 5.

A plurality of small protrusions 11 each having a pointed end are provided around the proximal portion of the post 4 on a top face of the seat plate 3. Consequently, when cloth C is sandwiched between a boss portion 2 of a button and this tack, the cloth C can be captured securely. Further, in addition to the small protrusions 11 on the top surface of the seat plate 3, plural rows of convex ring-like protrusions may be provided outside of those small protrusions 11. Further, provision of only the protrusions enables the cloth C to be captured.

The tack 1 is made of metal such as aluminum alloy and zinc alloy and its head and post are desired to be formed by forging or rolling. The shape of the head 5 to be provided at the end of the post 4 is not only quadrangular but may be polygonal pyramid. such as triangular pyramid, pentangular pyramid, sexangular pyramid. If the vertical angle of a peripheral face of such a polygonal pyramid is in a range of 20 to 40°, the head 5 can be formed to be sharp. In this case, when the cloth C is pierced, the tack 1 can be pierced in a linear contact with the cloth C, so that the puckering phenomenon never occurs in the cloth C.

Figure 3:
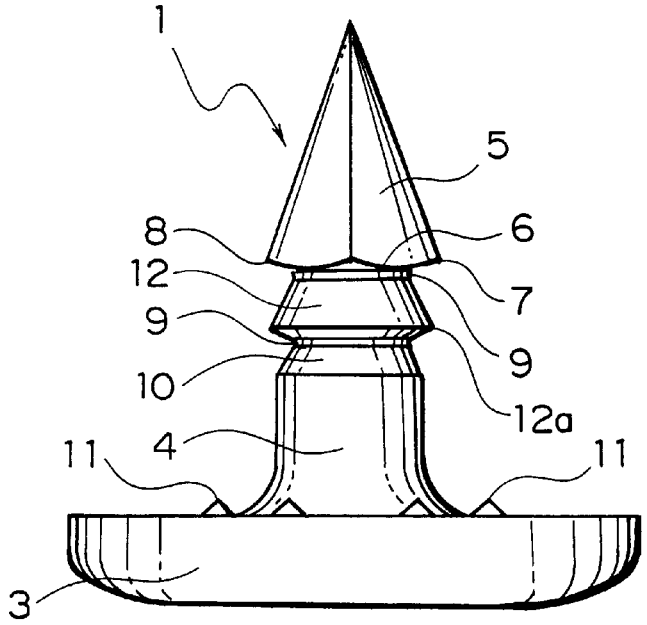
FIG. 3 is a front view of a tack according to a second embodiment of the present invention.
Figure 4:
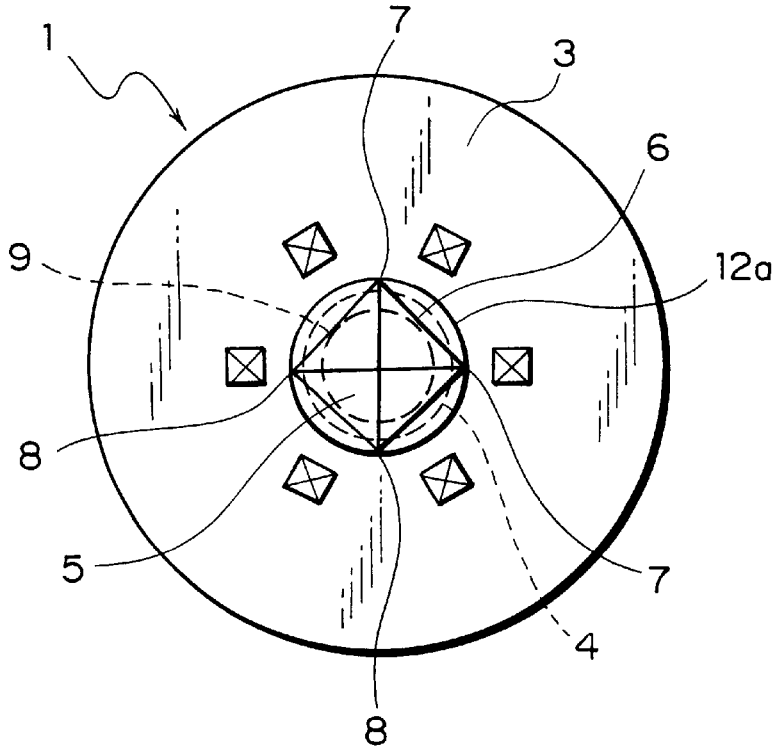
FIG. 4 is a plan view of the tack of FIG. 3.

In the tack 1 according to a second embodiment of the present invention, as shown in FIGS. 3 and 4, the post 4 stands upward from the center of the flat seat plate 3 and an end of the post 4 is provided with a quadrangular pyramid sharp head 5 in which a vertical angle of a peripheral face is in a range of 20 to 40°. A bottom face of the corner 7 extends inwardly substantially horizontally under this head 5 so that a narrow circular neck portion 9 is formed. This neck portion 9 is formed in a size internally contacting the proximal periphery 6 of the quadrangular pyramid head 5. As shown in FIG. 4, an engaging protruding portion 12*a* of a truncated cone 12 having the same diameter as the diameter of the corners 7 of the quadrangular pyramid head 5 is provided below this neck portion 9. And the engaging protruding portion 12*a* is provided not only to the truncated cone 12 but may be provided to projections which are provided to project individually with predetermined intervals. A bottom face of the engaging protruding portion 12*a* of this truncated cone 12 extends inwardly substantially horizontally so that a neck portion 9 having the same diameter as the aforementioned neck portion 9 is formed. Further, an outer peripheral face of the post 4 extending below this neck portion 9 is formed of a middle diameter between the engaging protruding portion 12*a* and the neck portion 9. Additionally, the small protrusions 11 are provided on the seat plate 3 around the post 4. Meanwhile, the diameter of the engaging protruding portion 12*a* may be set appropriately to be larger or smaller than the diameter of the corners 7.

Figure 5:
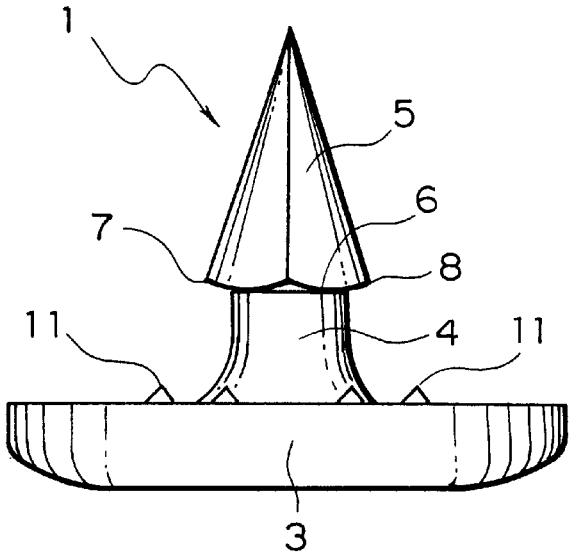
FIG. 5 is a front view of a tack according to a third embodiment of the present invention.
Figure 6:
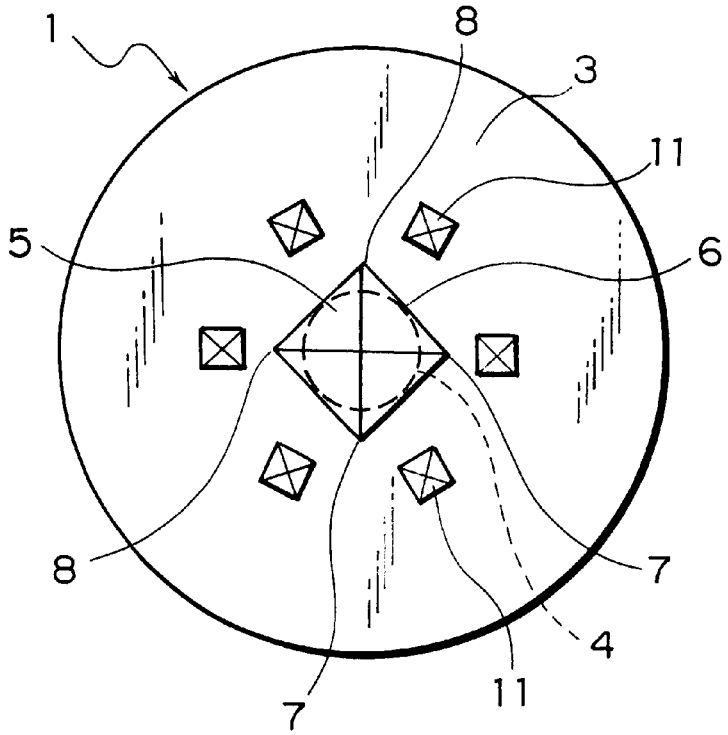
FIG. 6 is a plan view of the tack of FIG. 5.

In the tack 1 according to a third embodiment of the present invention, as shown in FIGS. 5 and 6, the cylindrical post 4 stands on the center of the flat seat plate 3. An end of the post 4 is provided with the quadrangular pyramid sharp head 5 in which a vertical angle of a peripheral face is in a range of 20 to 40°. The corners 7 of the quadrangular pyramid head 5 are protruded outside substantially horizontally from the post 4. A middle point between the corner 7 and corner 7 substantially coincides with an outer peripheral face of the post 4 as shown in FIG. 6. The length of the post 4 is shorter than those of the posts 4 of the above described two embodiments, so that the quadrangular pyramid head 5 is lower.

Figure 7:
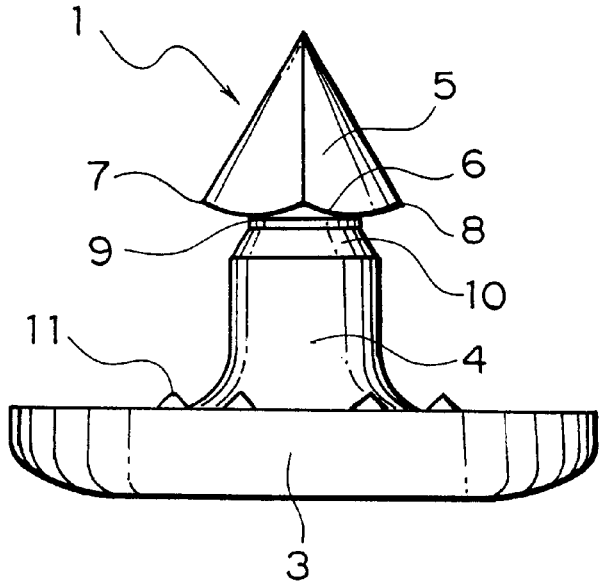
FIG. 7 is a front view of a tack according to a fourth embodiment of the present invention.
Figure 8:
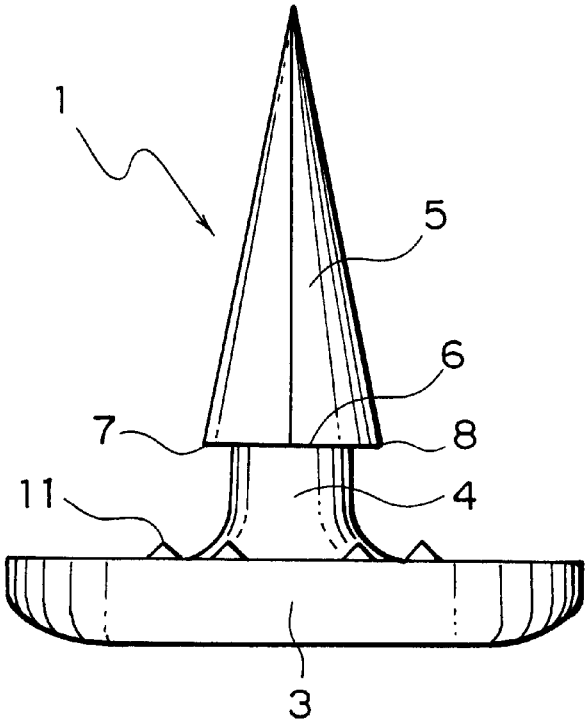
FIG. 8 is a front view of a tack according to a fifth embodiment of the present invention.

The range of 20 to 40° of the vertical angle of a peripheral face of the head 5 to be provided at the end of the post 4 is a preferable range and the angle does not always have to be within this range. For example, in the tack 1 according to a fourth embodiment of the present invention shown in FIG. 7, the head 5 has a vertical angle of more than 40° and in the tack according to a fifth embodiment of the present invention shown in FIG. 8, the vertical angle is less than 20° so that the head 5 is formed to be very sharply pointed. A bottom face of this head 5 extends inwardly horizontally from the engaging portion 8 to the post 4.

Figure 9:
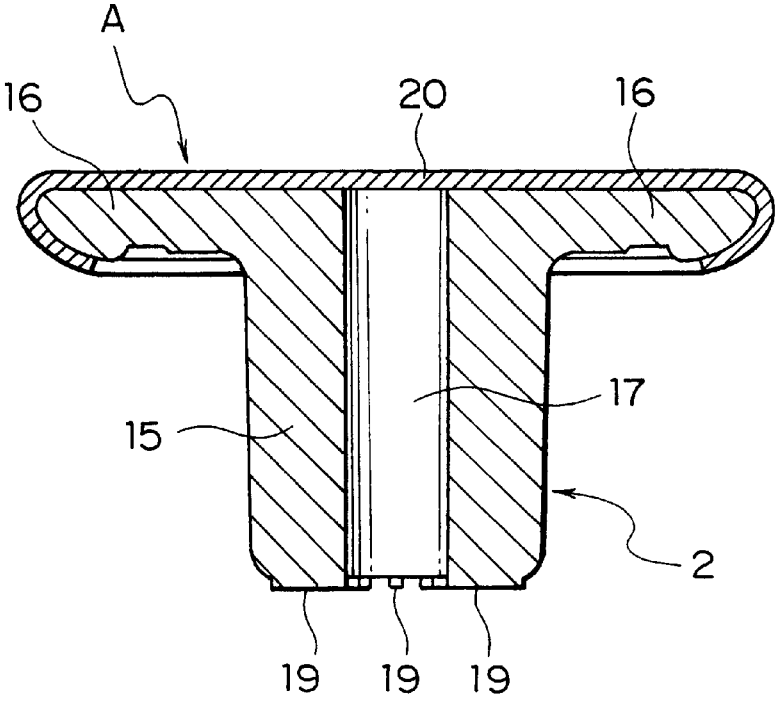
FIG. 9 is a sectional view of a button main body having a boss portion.

On the other hand, as for the configuration of the boss portion 2 corresponding to the tack 1, as shown in FIG. 9, a button fixing flange 16 is provided on a top end of a cylindrical body 15 so as to protrude horizontally so that a top face thereof is extended flat. A circular through tack attaching hole 17 is made in the center of the body 15. Several pieces of small protruding ridges 19 are arranged at a predetermined interval along the circumference around the attaching hole 17 in the bottom face of the body 15, such that they are protruded outwardly so as to bite into the cloth C. Preferably, the boss portion 2 is formed by injection molding using thermoplastic resin such as polyacetal, polyamide, polypropylene and polybutylene terphthalate. Meanwhile, the attaching hole 17 may be formed with a bottom.

As for assembly of a button main body A, a surface plate 20 of a button is placed on a flat top face of the boss portion 2 made of resin. Then, a periphery of the surface plate 20 is folded on the periphery of the flange 16 of the boss portion 2 so that the former is overlaid on the latter. Consequently, the surface plate 20 is fixed to the boss portion 2 so as to complete the button main body A.

Figure 10:
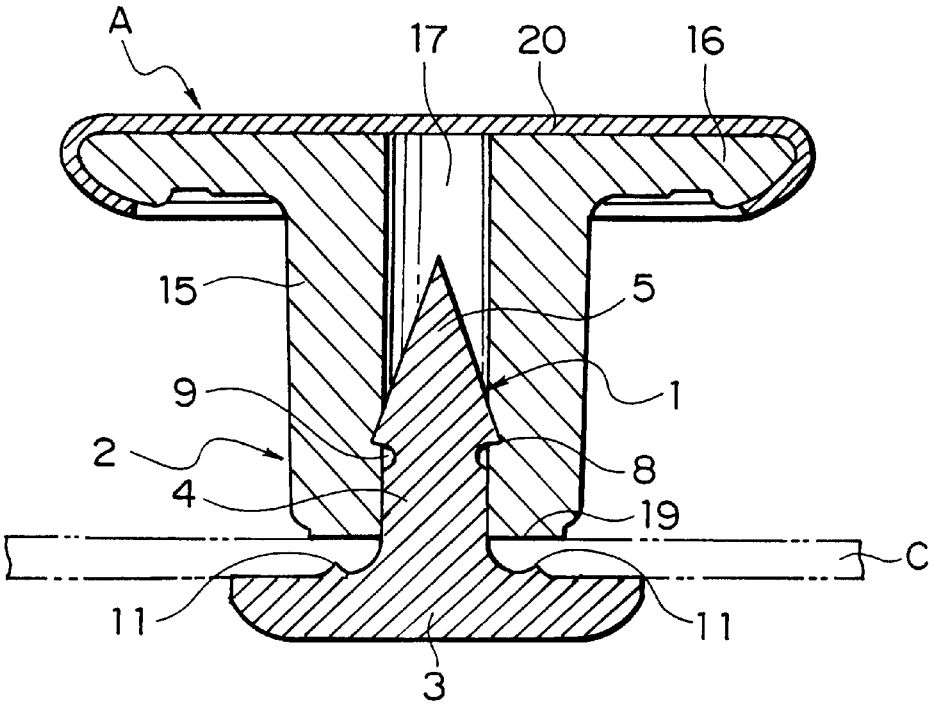
FIG. 10 is a sectional view showing a state in which the tack of the first embodiment is attached to the button main body.

When the aforementioned button main body A is intended to be fixed to the cloth C, for example, as shown in FIG. 10, the metallic tack 1 shown in FIG. 1 is pierced into the cloth C and inserted into the attaching hole 17 in the boss portion 2 made of resin of the button main body A shown in FIG. 9. Then, by pressing the seat plate 3 of the tack 1 against the button main body A, the four engaging portions 8 protruded from the post 4 of the tack 1 bite into a wall face of the attaching hole 17 so that they engage. Consequently, the tack 1 is fixed in the attaching hole 17 in unmovable condition by the engaging portions 8 and the post 4. At that time, the cloth C is prevented from sliding relatively by the small protrusions 11 provided on the seat plate 3 of the tack 1 and small protruding ridges 19 provided on the bottom face of the boss portion 2, so that the button main body A is fixed firmly to the cloth C.

Figure 11:
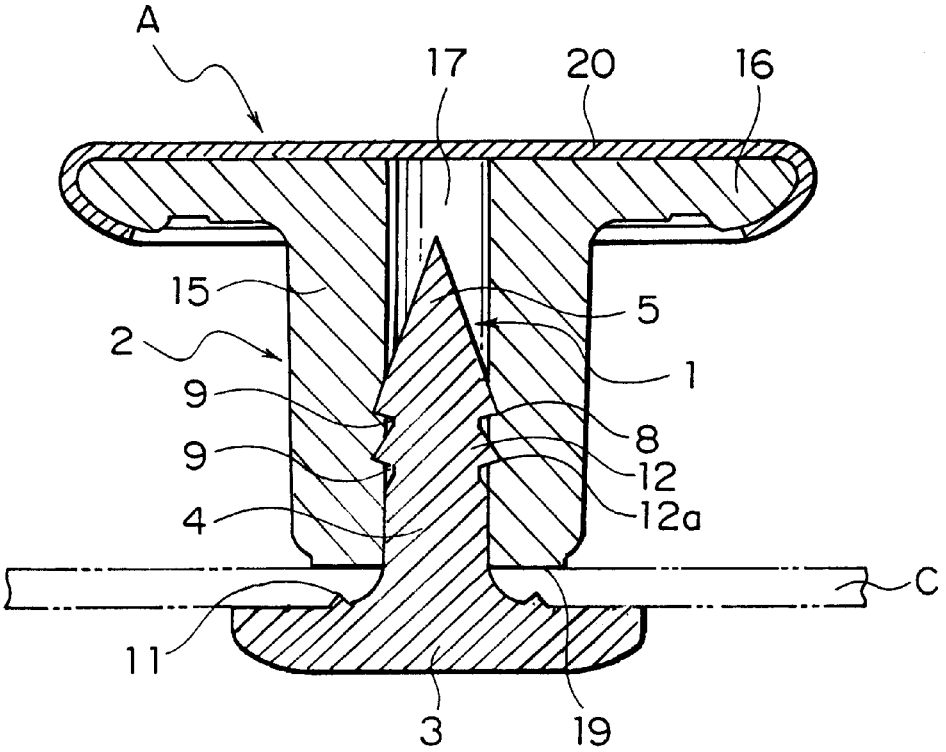
FIG. 11 is a sectional view showing a state in which the tack of the second embodiment is attached to the button main body.

As for another example, as shown in FIG. 11, the tack 1 shown in FIG. 3 is pierced into the cloth C and inserted into the attaching hole 17 in the boss portion 2 of the button main body A shown in FIG. 9. By pressing the seat plate 3 of the tack 1 against the button main body A, the four engaging portions 8 of the tack I bite into a far wall face of the attaching hole 17 and the engaging protruding portions 12*a* protruded with respect from the peripheral face of the post 4 bite into a near wall face of the attaching hole 17 so that the engagement is achieved with two stages. Consequently, the tack 1 is fixed to the attaching hole 17 in unmovable condition. The cloth C is prevented from sliding relatively by the small protrusions 11 provided on the seat plate 3 of the tack 1 and the small protruding ridges 19 provided on the bottom face of the boss portion 2, so that the button main body A is fixed firmly to the cloth C.

Figure 12:
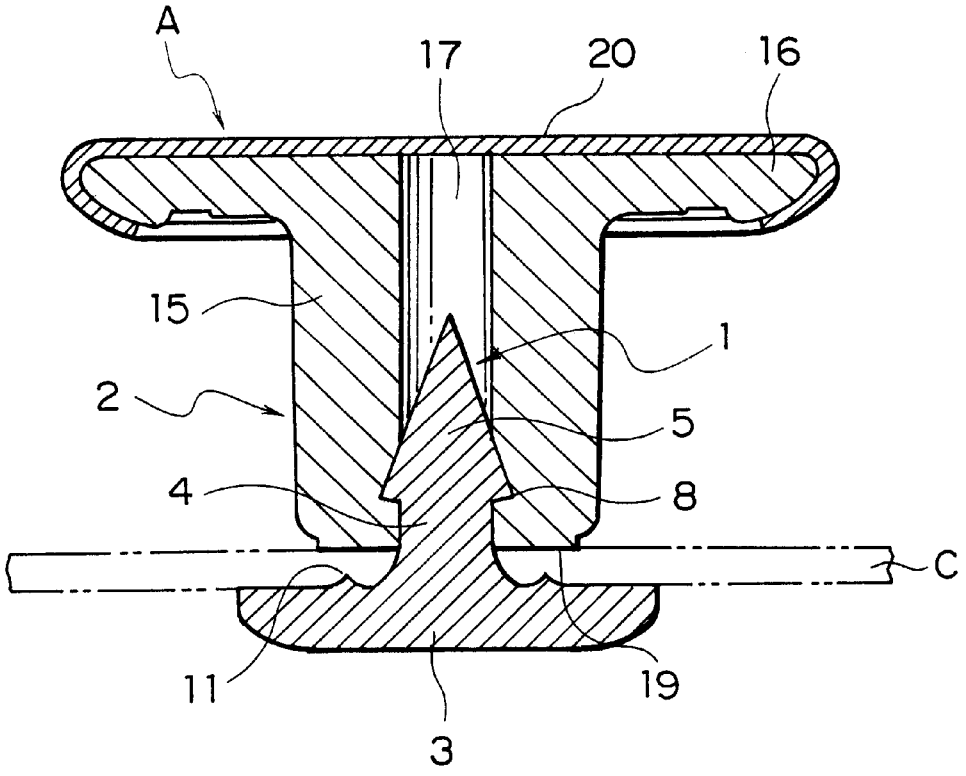
FIG. 12 is a sectional view showing a state in which the tack of the third embodiment is attached to the button main body.
Figure 13:
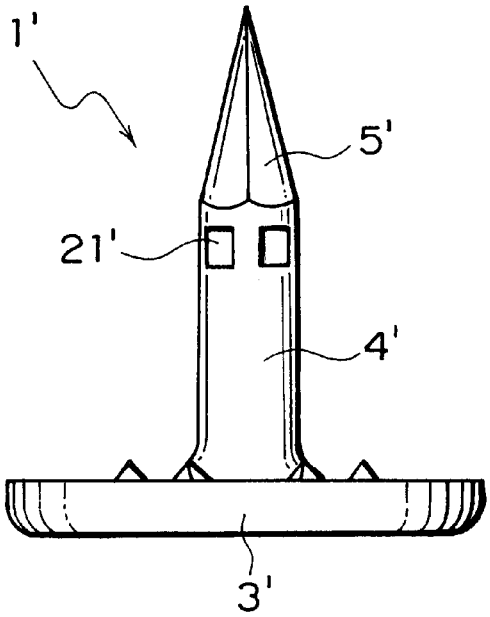
FIG. 13 PRIOR ART
FIG. 13 is a front view of a tack according to a first known example.
Figure 14:
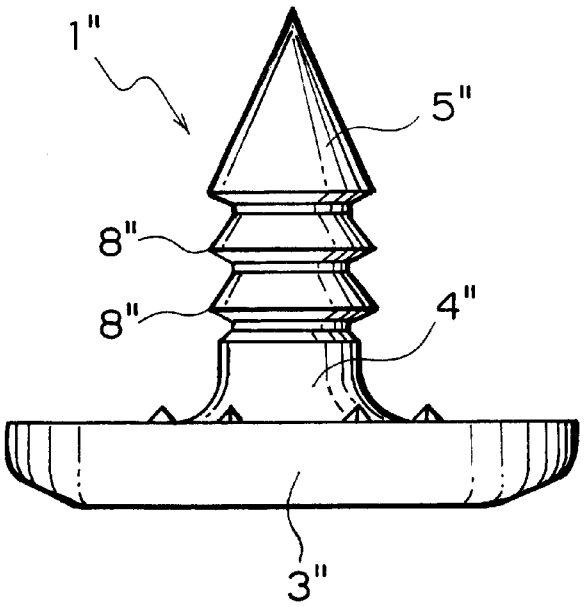
FIG. 14 PRIOR ART
FIG. 14 is a front view of a tack according to a second known example.

As for still another example, as shown in FIG. 12, the tack 1 shown in FIG. 5 is pierced into the cloth C and inserted into the attaching hole 17 in the boss portion 2 of the button main body A shown in FIG. 9. By pressing the seat plate 3 of the tack 1 against the button main body A, the four engaging portions 8 protruded at low positions above the post 4 of the tack 1 bite into the wall face near an entrance 18 of the attaching hole 17 sharply so that they engage. Consequently, the tack 1 is fixed into the attaching hole 17 unmovably by the engaging portions 8 and the post 4. The cloth C is prevented from sliding relatively by the small protrusions 11 provided on the seat plate 3 of the tack 1 and the small protruding ridges 19 provided on the bottom face of the boss portion 2, so that the button main body A is fixed firmly to the cloth C.

The tack for button and the boss portion of the present invention have the above described structures. With the structures, the following effects are realized.

According to the main aspect of the invention, there is provided the tack 1 for button wherein the post 4 stands on the center of the flat seat plate 3; the polygonal pyramid shaped head 5 is formed integrally at the end of the post 4; and the corners 7 provided on the proximal periphery 6 of the head 5 are protruded out with respect of a peripheral face of the post 4 so as to form the engaging portion 8. Thus, because the head 5 is of polygonal pyramid, when cloth is pierced, the tack 1 makes a linear contact with the cloth so that contact resistance is small. As a result, the puckering phenomenon is not likely to occur so that the button can be fixed with a good appearance Further, this tack 1 has a simple structure and strong engaging portion. Because the tack 1 is fixed by means of the engaging portion protruding with respect from the post 4, the engaging portion 8 bites into the attaching hole 17 in the boss portion 2 so that the tack 1 is fixed firmly.

According to the invention, there is provided a tack 1 for button, wherein the proximal periphery 6 of the polygonal pyramid shaped head 5 is protruded out with respect to an outer peripheral face of the post 4. As a result, the tack 1 can be engaged with the attaching hole 17 in the boss portion 2 by the entire proximal end, as well as the engaging portion 8, of the head 5. Therefore, the tack can be fixed firmly.

According to the present invention, there is provided a tack 1 for button, wherein part of the proximal periphery 6 between the corner 7 and adjacent corner 7 in the polygonal pyramid head 5 is located inside with respect to the outer peripheral face of the post 4. As a result, engagement by the engaging portion 8 of the head 5 can be achieved efficiently and the tack 1 can be inserted into the boss portion 2 easily.

According to the present invention, there is provided a tack 1 for button, wherein the bottom face of each of the corners 7 of the head 5 extends inwardly at a border between the head 5 and the post 4 so that the circular neck portion 9 thinner than the post 4 is formed. As a result, the head having an excellent engaging efficiency and piercing efficiency can be formed on the post 4 of the tack 1.

According to the present invention, there is provided a tack 1 for button, wherein the neck portion 9 thinner than the post 4 is formed under the head 5; the engaging protruding portion 12*a* is provided on the post 4 below the neck portion 9 so as to protrude therefrom. As a result, the tack 1 can be fixed to the boss portion 2 through two stages, so that it is fixed firmly.

According to the present invention, there is provided a tack 1 for button, wherein the vertical angle of each of peripheral faces formed on the polygonal pyramid head 5 is in the range of 20 to 40°. As a result, the shape of the head 5 to be formed at an end of the post can be made sharper. When it is intended to pierce cloth, it can be pierced easily, so that the puckering phenomenon is not likely to occur.

According to the present invention, there is provided a tack 1 for button, wherein the tack 1 is formed of metal and the boss portion in which the tack 1 is to be inserted is formed of thermoplastic resin. Therefore, the tack 1 and the boss portion 2 can be produced easily. Further, the engaging performance can be intensified easily. That is, the effects of the present invention are very remarkable.

What is claimed is:

1. A tack for button comprising a post standing on the center of a flat seat plate; wherein a polygonal pyramid shaped head is formed integrally at an end of said post; and corners provided on a proximal periphery of the head are protruded out of a peripheral face of the post so as to form an engaging portion.

2. A tack for button according to claim 1, wherein the proximal periphery of the polygonal pyramid shaped head is protruded out of an outer peripheral face of the post.

3. A tack for button according to claim 1, wherein part of the proximal periphery between the corner and adjacent corner in the polygonal pyramid head is located inside with respect to the outer peripheral face of the post.

4. A tack for button according to claim 1, wherein a bottom face of each of the corners of the head extends inwardly at a border between the head and the post so that a neck portion thinner than the post is formed.

5. A tack for button according to claim 1, wherein a neck portion thinner than the post is formed under the head; an engaging protruding portion is provided on the post below the neck portion so as to protrude therefrom.

6. A tack for button according to claim 1, wherein a vertical angle of each of peripheral faces formed on the polygonal pyramid head is in a range of 20 to 40°.

7. A tack for button according to claim 1, wherein the tack is formed of metal and a boss portion in which the tack is to be inserted is formed of thermoplastic resin.

* * * * *